United States Patent [19]

Yamane et al.

[11] Patent Number: 5,063,085

[45] Date of Patent: Nov. 5, 1991

[54] COATING METHOD

[75] Inventors: Takakazu Yamane; Yoshio Tanimoto; Tadamitsu Nakahama, all of Hiroshima, Japan

[73] Assignee: Mazda Motor Corporation, Hiroshima, Japan

[21] Appl. No.: 560,994

[22] Filed: Aug. 1, 1990

[30] Foreign Application Priority Data

Aug. 1, 1989 [JP] Japan ..... 1-201074

[51] Int. Cl.[5] ..... B05D 1/102; B05D 3/00

[52] U.S. Cl. ..... 427/240; 427/346; 427/388.1; 427/398.1; 427/421; 427/425; 427/426

[58] Field of Search ..... 427/240, 388.1, 398.1, 427/421, 426, 425, 346

[56] References Cited

U.S. PATENT DOCUMENTS 4,874,639 10/1989 Matsui et al. ..... 427/240

*Primary Examiner*—Janyce Bell

*Attorney, Agent, or Firm*—Fish & Richardson

[57] ABSTRACT

Disclosed is a coating method involving a coating step step and a drying step, in which the substrate is sprayed with a paint on its surface extending substantially upwardly and downwardly with the paint to form a coat in a thickness thicker than a thickness at which the paint starts sagging in the coating step and the coat formed on the substrate is dried at the drying step by rotating the substrate about its axis extending in a substantially horizontal and longitudinal direction of the substrate for a period of time ranging from the time when the paint coated starts sagging on the surface of the substrate extending substantially upwardly and downwardly to the time when the paint of the coated formed thereon achieves a substantially sagless state, the rotation of the substrate sprayed with the paint thereon being carried out at a speed which is high enough to rotate the substrate from a vertical position to a horizontal position before the paint coated thereon substantially sags due to gravity yet which is low enough so as to cause no sagging as a result of centrifugal force; and a cooling step for cooling the coat formed by spraying the substrate with the paint is provided immediately after the coating step yet before the drying step.

23 Claims, 10 Drawing Sheets

COATING METHOD

BACKGROUND OF THE INVENTION

1. Field of the Invention

The present invention relates to a coating method.

2. Description of Related Art

A method of coating an outer surface of a coating substrate such as a vehicle body generally includes steps: the preparatory step of removing dirt attached on the coating substrate, the coating step of spraying the coating substrate with a paint and the drying step of drying the paint coated on the coating substrate. The drying step may generally be executed at two stages: a setting step and a baking step. The setting step is usually carried out prior to the baking step at temperatures lower than those applied in the baking step, for example, in ambient atmosphere or at temperatures of 40° to 60° C., as is called temporary baking. The temperature in the baking step may usually be around approximately 140° C.

In usual case, the coating substrate is being passed through the preparatory step, the coating step and the drying step while being transported on a transporting means such as a carriage. The coating substrate is held in a given posture at each step, in which the substrate is treated.

As one standard for evaluating the quality of a coated surface is a degree of evenness (a degree of smoothness). The greater the degree of evenness becomes, the smaller a degree of irregularities or roughness on the coated surface, thereby providing a better coated surface. In order to improve the degree of evenness, it is known that it can be done if the thickness of a coated layer, that is, the thickness of a paint coated, is made thicker.

On the contrary, the "sagging" of a paint is a factor for adversely affecting the quality of the surface of the coated substrate. The sagging arises as the coated paint flows downwardly to a large extent due to gravity, and a "sag" is more likely to occur as the thickness of a paint coated per once gets larger. The cause of the "sag" is eventually an influence of the gravity so that the sagging is likely to arise on a surface of the coating substrate extending in its vertical direction, that is, a so-called vertical surface. For example, with the body of the automotive vehicle taken into consideration as a coating substrate, a fender extending vertically is likely to cause sagging while a bonnet and a trunk lid extending transversely are unlikely to cause sagging, when coated with a paint.

Accordingly, it is possible to render the thickness of the paint thicker on a surface of the coating substrate extending in a horizontal direction, that is, a so-called horizontal surface, which does not cause problems with the "sagging" so much, than on the vertical surface. Furthermore, if the thickness of the coat layer on the horizontal surface is made equal to that on the vertical surface, irregularities on the horizontal surface is rendered smaller due to the flow of the paint coated thereon to such an extent as causing no sagging, than the vertical surface, and a higher degree of evenness is provided on the horizontal surface than on the vertical surface.

From the above point of view, heretofore, the coating is effected using a paint having the smallest possible flowability, or the lowest possible viscosity, in order to provide a coated surface with the highest possible degree of evenness while preventing the "sagging" of the coated paint. And a so-called "sagging limit" that is a limit to the thickness of the paint, which causes sagging on the vertical surface, is approximately 40 μm that is the maximum that is the thickness of the coat layer for conventional thermosetting. More specifically, the "sag" of such thermosetting paints is likely to occur at the initial stages of the setting and baking steps, particularly at the initial stage of the baking step, so that the thickness of the paint to be coated in the coating step is determined so as to cause no "sag" at this stage. And the maximum thickness of the paint determined at this stage is the so-called sagging limit of 40 μm. Accordingly, in order to provide a coat surface with an absolutely higher degree of evenness, conventional coating methods require, for example, a dual coating and so on, that is, a series of steps ranging from the coating step to the baking step to be repeated plural times.

U.S. Pat. Nos. 4,874,639 and 4,919,977 disclose coating methods which can provide a coat surface having a higher degree of evenness, when the film thicknesses of the two coats are the same, while overcoming the sagging limit of the paint which may cause a problem when coated by spraying in the manner as described hereinabove. More specifically, the coating method involves coating by spraying with the paint so as to form a coat layer having a film thickness thicker than its sagging limit and rotating the coated substrate about its substantially horizontal axis until the paint coated causes no sagging any longer. This coating method can provide a coat surface having a higher degree of evenness, when the thicknesses of the two coats are the same, while occurrence of the sag of the paint can be prevented, by taking positive advantage of such a high flowability of the paint used.

These coating methods, however, cause the risk that the paint sprayed may sag during the transient period from the coating step to the drying step. As long as the paint is sprayed in a film thickness thicker than its sagging limit at which it starts sagging or it is sprayed in such a film thickness by diluting the paint with a solvent or the like in these coating methods, the paint may cause the risk of sagging or dripping immediately after it has been sprayed. In this case, the sagging of the paint should be suppressed during the transient period when the coated substrate is transferred from the coating step to the drying step, if transferral of the coated substrate from the coating step to the drying step would require a certain period of time.

On the other hand, it can be noted as a matter of course that the paint can be prevented from sagging or dripping by spraying the coating substrate with the pain in a film thickness thinner than its sagging limit at which it causes sagging at least during the transient period or by diluting the paint with the solvent or the like to make flowability of the paint smaller. However, these techniques suffer from the disadvantages as conventional coating methods do and they may reduce the advantages that have been achieved with much effort by the coating methods as disclosed in the prior patents as hereinabove described, which have overcome the barrier set by a sagging limit of the paint to be sprayed.

SUMMARY OF THE INVENTION

Therefore, the present invention has the object to provide a coating method adapted so as to suppress the occurrence of sags of a paint sprayed on a coating substrate during a period of time when the substrate coated is being transferred from the coating step to the drying step by physically making the paint sprayed on the coating substrate less flowable, without imposing restrictions on the coating conditions under which the substrate is sprayed with the paint.

In order to achieve the above object, the present invention consists of a coating method comprising a coating step for spraying a substrate with a paint and a drying step for drying the paint sprayed on the substrate;

wherein the coating step is to spray a surface of the substrate extending substantially upwardly and downwardly with the paint to form a coat in a thickness thicker than a thickness at which the paint starts sagging;

the drying step is to dry the coat formed on the substrate by rotating the substrate about its axis extending in a substantially horizontal and longitudinal direction of the substrate for a period of time ranging from the time when the paint coated starts sagging on the surface of the substrate extending substantially upwardly and downwardly to the time when the paint of the coated formed thereon achieves a substantially sagless state, the rotation of the substrate sprayed with the paint thereon being carried out at a speed which is high enough to rotate the substrate from a vertical position to a horizontal position before the paint coated thereon substantially sags due to gravity yet which is low enough so as to cause no sagging as a result of centrifugal force; and a cooling step for cooling the coat formed by spraying the substrate with the paint is provided immediately after the coating step yet before the drying step.

This arrangement for the steps of the coating method allows the coat formed on the substrate to be dried without causing sagging because the paint coated on the substrate does not sag due to changes of the direction in which gravity acts on the coat formed thereon by rotating the substrate about its axis extending in the substantially horizontal and longitudinal direction of the substrate, the axis being sometimes referred to merely as "horizontal axis" or related words.

This enables a film thickness of the coat to be formed by one shot of coating to such an extent as being far thicker than conventional coating methods, thereby providing a coat surface having a degree of evenness that is higher than the level that is to be considered as a limit by the conventional methods. It is also to be noted that, when film thicknesses of the two coats are the same, this coating method can provide a coat surface having a smaller degree of irregularity, i.e., a higher degree of evenness, than the conventional methods. It is further to be noted that, when a coat is intended to be provide, which has its surface having the identical degree of evenness, for example, as high as the one obtainable by the conventional methods, then this coating method can thin the film thickness of the coat, thereby saving the amount of the paint to be otherwise consumed.

It is to be understood herein that the paint may be sprayed by electrostatic coating. And the sag of the paint is intended to mean a movement of the paint to such an extent such a movement can be recognized by visual observation when the paint is left as it was sprayed (which is observed as marks in a string-like form), and that the paint has sagged is determined when the paint flows generally by approximately 2 mm. Hence, the fact that the spraying of the paint in a film thickness thicker than its sagging limit means such a film thickness of the paint as causing the paint to flow at least by approximately 2 mm when it is left as it was sprayed. It is thus to be understood that the higher the flowability of the paint used, the thinner its sagging limit thickness of the paint to be sprayed. In order to make the film thickness of the coat thicker than its sagging limit thickness, the paint may be sprayed once (as in a manner as called "one-stage spraying") or in two or three or more installments ("multi-stage spraying") to thereby provide a final film thickness which is thicker than its sagging limit thickness. It is also to be noted that, as the rotation of the coated substrate about its approximately horizontal axis be sufficiently carried out to such an extent that the paint coated is not caused to flow largely due to gravity, the coated substrate may be rotated continuously or intermittently in one direction or in alternate directions until the paint becomes in such a less flowable state as causing no sagging, i.e., during a period of time when that the paint gets cured. Furthermore, the angle at which the coated substrate is rotated about its horizontal axis at approximately 270° as high as an arbitrary portion of the coat formed by spraying with the paint in the film thickness thicker than its sagging limit can be reversed relative to the direction of gravity. And the axis about which the coated substrate is rotated may be inclined at approximately 30° relative to the real horizontal axis thereof or may be pivoted.

It is further to be noted that the terms "surface of the substrate extending substantially upwardly and downwardly" and the related terms referred to herein are intended to mean such a surface of the substrate as extending in an upward and downward direction, or ascending and descending, on which the paint sprayed thereon flows downwardly and starts sagging due to gravity when the coat of the paint is left without being rotated.

The cooling step to be applied to the coating method according to the present invention is such that the paint in the coat formed on the substrate increases its viscosity so as to make the coat less flowable and unlikely to flow downwardly to such an extent that the paint of the coat formed thereon does not sag during the transient time period when the substrate is being transferred from the coating step to the drying step. In other words, the flowability of the paint is reduced by cooling the paint of the coat formed on the substrate, thereby suppressing the occurrence of sags of the paint on the surface of the substrate extending substantially upwardly and downwardly, or substantially vertically.

Other objects, features and advantages of the present invention will become apparent in the course of the description of the preferred embodiments, which follows, in conjunction with the accompanying drawings.

BRIEF DESCRIPTION OF THE DRAWINGS

FIG. 5(*b*) is a partially sectional view showing the setting step of the coating line.

FIG. 5(*c*) is a partially sectional view showing the baking step of the coating line.

DETAILED DESCRIPTION OF THE PREFERRED EMBODIMENTS

The present invention will be described in more detail by way of examples with reference to the accompanying drawings.

Outline of Coating Method

Figure 1:
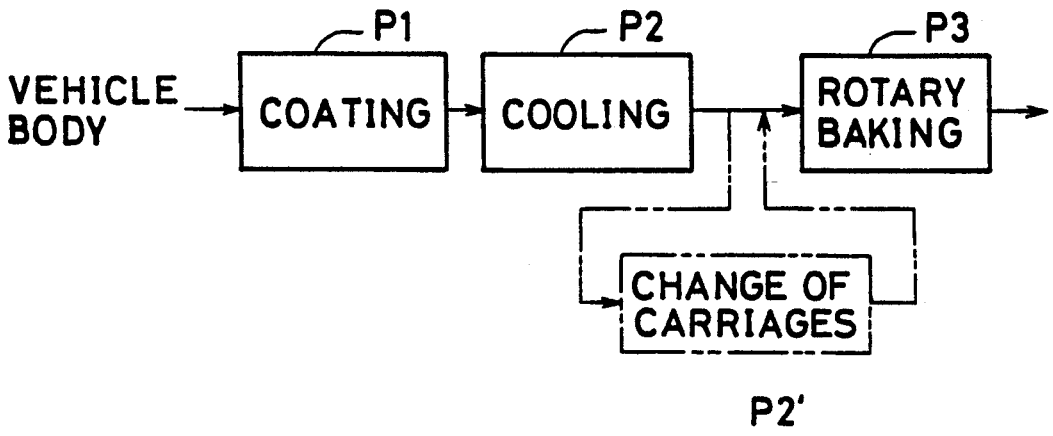
FIG. 1 is a diagrammatic representation of an outline of the coating method according to the present invention.

FIG. 1 shows an outline of the whole steps of the coating method according to the present invention, in which a vehicle body as a coating substrate is coated and the steps are indicated by steps P1 to P3, respectively.

The vehicle body is first undercoated by per se known electrodeposition method and then conveyed to the coating step P1 while being supported by a carriage. In the coating step P1, an outer face of the body is sprayed as a whole with a paint in a desired color to form a coat. The body W is then transferred to cooling step P2. The coat formed on the body is then cooled at the cooling step P2 and thereafter transferred to drying step P3 where the body is sequentially set and baked to dry the coat to a sufficient degree of dryness.

Figures 2A, 2B, 2C, 2D, 2E, 2F, 2G, 2H, 2I:
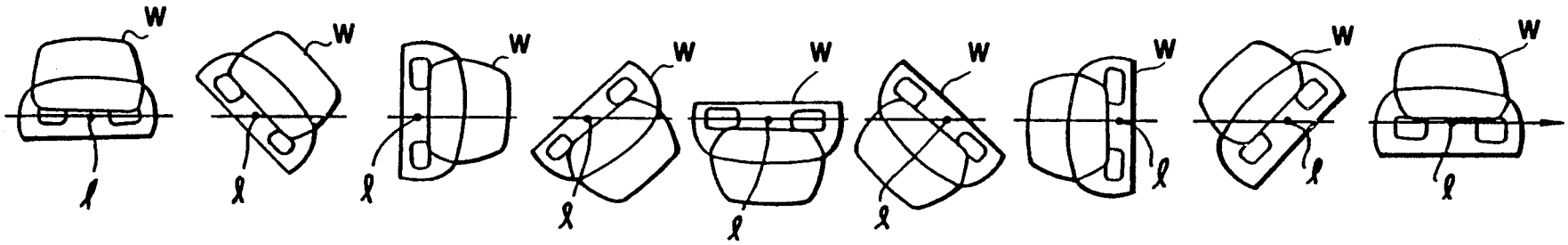
FIG. 2 is a diagrammatic representation showing changes of the postures of the vehicle body while being rotated.

In the coating step P1, the substrate is sprayed with the paint form a coat having a film thickness thicker than a thickness that causes sagging if the coat would be stayed as it has been sprayed. In the drying step P3, the substrate is rotated about its substantially horizontal axis in such a manner as shown in FIG. 2, until the coat formed on the surface of the substrate is set and dried to a sufficient degree of dryness.

The speed of rotating the substrate, such as the vehicle body W and so on, may vary with the film thickness and the viscosity of the paint sprayed. Basically, the substrate is rotated at the speed between such an upper limit value and a lower limit value as will be defined hereinafter. The upper limit value of the speed at which the substrate rotates is a minimum value of the rotating speed at which the coated substrate is turned at least from its vertical state to its horizontal state before the paint on the surface of the coat flows downwardly by its weight and sags due to gravity. On the other hand, the upper limit value of the rotating speed is a maximum value thereof at which the paint causes no sagging as a result of centrifugal force. The coated substrate may preferably be rotated at a speed of 380 cm per second or slower, measured at a radially outward tip portion of the substrate. It is to be noted herein that, when the coated substrate is rotated about its substantially horizontal axis, the rotary axis may be inclined at approximately 30° with respect to the horizontal axis thereof, preferably at about 10° or smaller.

The time period for which the coated substrate is rotated in the drying step about its substantially horizontal axis may last from the time before the paint coated begins sagging on its coat surface to the time when it is cured to a sagless state. With equipment and other things taken into account, the coated substrate may be rotated over the entire length of the drying step. The rotation of the coated substrate may be continuous or intermittent in one direction, alternate in one direction and thereafter in the opposite direction, or intermittent with interruption for suspension of the rotation.

Specific Examples of Conditions for Coating Vehicle Body (1) Undercoating paint:
Cationic electrodeposition
Baking: 170° C. for 30 minutes
Film thickness: 20±2 μm
(2) Overcoating
1) Paint with viscosity of 0.6 poise:
- a. Paint: Melamine alkyd high-solid thermoset-type paint (main resin component: average molecular weight, 2,800; color: black)
- b. Viscosity for spraying: 0.6 poise
- c. Non-volatilizable components: 48% by weight
- d. Solvents: Toluene, 25 parts by weight; Solvesso 100, 25 parts by weight; Solvesso 150, 50 parts by weight
- e. Agent for preventing sags: cross-linked acrylic resin acrylic resin powder, 3% by weight based on the weight of the non-volatilizable components
- f. Coater: Minibell (bell size: 60 mm; Nippon Lundsberg, K. K.) Number of revolutions of mini-bell: 16,000 rpm Voltage: −90 kv Shaping air pressure: 3.0 kg/cm$^2$ Distance from gun: 30 cm Spraying: two-stages in the 5-minute interval
- g. Spraying atmosphere: 20° C.±2° C. Air velocity in booth: 0.3±0.1 m/second (push-and-pull down flow)
- h. Setting conditions: Starting temperature, 20° C.±2° C.; setting time period, 7 minutes
- i. Baking conditions: temperature, 140° C./time period, 25 minutes; Rate of elevating baking temperatures: 8 minutes (from 20° C. to 140° C.)
- j. Rotating conditions: Rotating the coated substrate about its horizontal axis away by 75 cm from the central axis thereof so as to allow its both side surfaces parallel to each other at the speed of 6 rpm.

2) Paint with viscosity of 0.2 poise:

a. Paint: Same as above
b. Viscosity for spraying: 0.2 poise
c. Non-volatilizable components: 35% by weight
d. Solvents: Toluene, 35 parts by weight; Solvesso 100, 25 parts by weight; Solvesso 150, 50 parts by weight
e. Agent for preventing sags: Same as above
f. Coater: Same as above
g. Spraying atmosphere: Same as above
h. Setting conditions: Same as above
i. Baking conditions: Same as above
j. Rotating conditions: Same as above.

Two-Liquid Type Paint

The intercoating and overcoating were executed with the same paint under conditions as follows:

a. Paint: Polyester urethane paint; white ("P-263"; Nippon Bee Chemical K. K.) Main resin: polyester polyol Curing agent: hexamethylene diisocyanate Admixture ratio: 4 (main resin) to 1 (curing agent)
b. Coater: Pressure-flow type air spray gun (Iwata Tosoki K.K.; "Wider-W71")
c. Spraying viscosity: 0.6 poise and 0.2 poise
d. Amount of paint sprayed: 350 cc per minute
e. Shaping air pressure: 4.0 kg/cm$^2$
f. Distance from gun: 30 cm
g. Interval between two coatings: 5 minutes
h. Drying conditions: Setting, 7 minutes (at room temperature) 90° C. for 25 minutes (elevated from 20° C. to 90° C. for 5 minutes)

Thermoset-type Paint (1) Intercoating:
a. Paint: Thermosetting, oil-free, polyester urethane paint; gray
b. Viscosity for spraying: 0.6 poise and 0.2 poise
c. Coater: Minibell (bell size: 60 mm) Number of revolutions: 22,000 rpm Voltage: −90 kv Shaping air pressure: 3.0 kg/cm$^2$ Distance from gun: 30 cm
d. Drying conditions: Setting, 7 minute (room temperature) thereafter 140° C. for 25 minutes (2) Overcoating:
a. Paint: Thermosetting, acryl melamine paint; black
b. Viscosity for spraying: 0.6 poise and 0.2 poise
c. Amount of unvolatilizable components: 42% by weight (0.6 poise) 33% by weight (0.2 poise)
d. Solvents: (i) 0.6 poise: Toluene: 50% by weight Solvesso 100: 50% by weight (ii) 0.2 poise: Toluene: 55% by weight Solvesso 100: 45% by weight
e. Agent of Preventing Sags: Cross-linked acryl resin powders (6% by weight per unvolatizable components)

The other conditions such as coaters are the same as the melamine alkyd, high-solid, thermoset-type paint has been coated as described hereinabove.

Preferred Paints for Vehicle Body

The paints to be used for coating particularly vehicle bodies W may be any paint containing a resin having a number average molecular weight ranging from 2,000 to 20,000, as shown in Table 1 below.

The reasons for preference to the paint having the resin with the number average molecular weight ranging from 2,000 to 20,000 is because those having the number average molecular of less than 2,000 correspond to paints that can be cured by electron rays or ultraviolet rays and they are so brittle due to their high cross-link density that they are less durable (two to three Years) so that they are not preferred for outer panels of automotive vehicles, while a latex polymer having the number average molecular weight greater than 20,000 becomes highly viscous immediately after spraying and hard to improve a degree of evenness, so that such a polymer is not preferred.

TABLE 1

| Paint | Resin | Type | Number-Average Molecular Weight |
|---|---|---|---|
| Solid Paint | Melamine Alkyd | General High Solid | 4,000–5,000 2,000–3,000 |
| Metallic Base Paint | Melamine Acrylate | General High Solid | 15,000–20,000 2,000–3,000 |
| Metallic Clear Paint | Melamine Acrylate | General High Solid | 5,000–6,000 2,000–3,000 |
| Solid Paint | Urethane Isocyanate | General High Solid | 7,000–10,000 2,000–3,000 |

Figure 3:
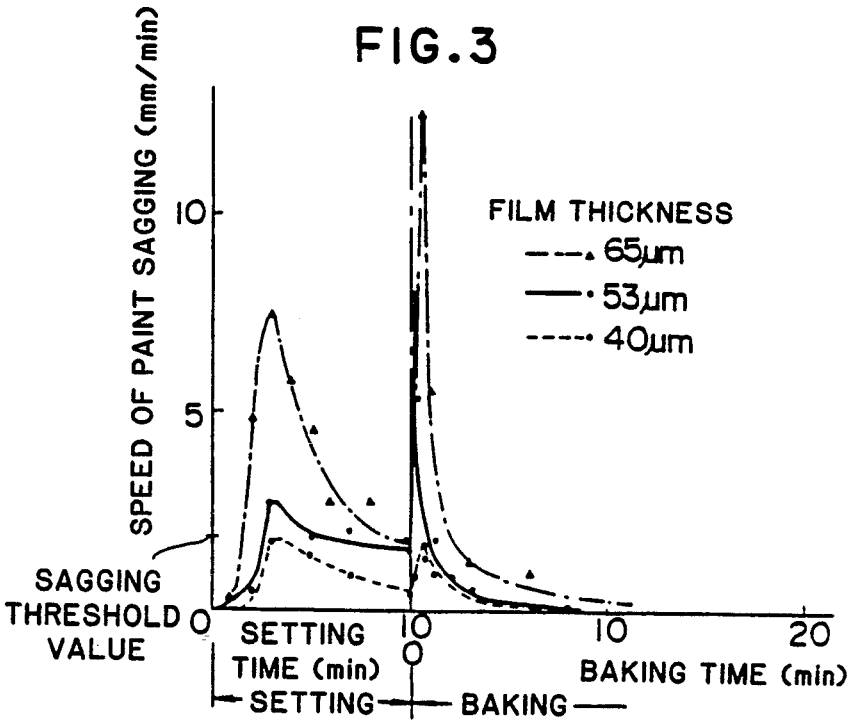
FIG. 3 is a graph showing the relationship of the speed of paing sagging vs. the setting and baking times.

Relationships of Coat Thickness with Sagging Limit, Degree of Smoothness, and Rotation about Horizontal Axis FIG. 3 indicates influences of film thicknesses of a coat of a thermosetting paint on the sagging limit. FIGS. 3 takes three different kinds of film thicknesses, i.e., 40 μm, 53 μm and 65 μm, as examples. In each case, it can be understood that sags have reached their peak points in the early stages of both the setting step and the baking step. The sagging limit of the paint is usually defined as the value at the time when sags are caused to occur at a rate ranging from 1 to 2 mm per minute. More specifically, the sagging limit of the paint is a limit of the film thickness at which, in the drying step, a mark indicated by the movement of the paint by 1 to 2 mm from the original position in which the paint had been coated can be recognized on the coat surface after having been dried. Using a conventional paint, the maximum film thickness that had ever been obtained at a range below a sagging limit was as thin as about 40 μm.

Figure 4:
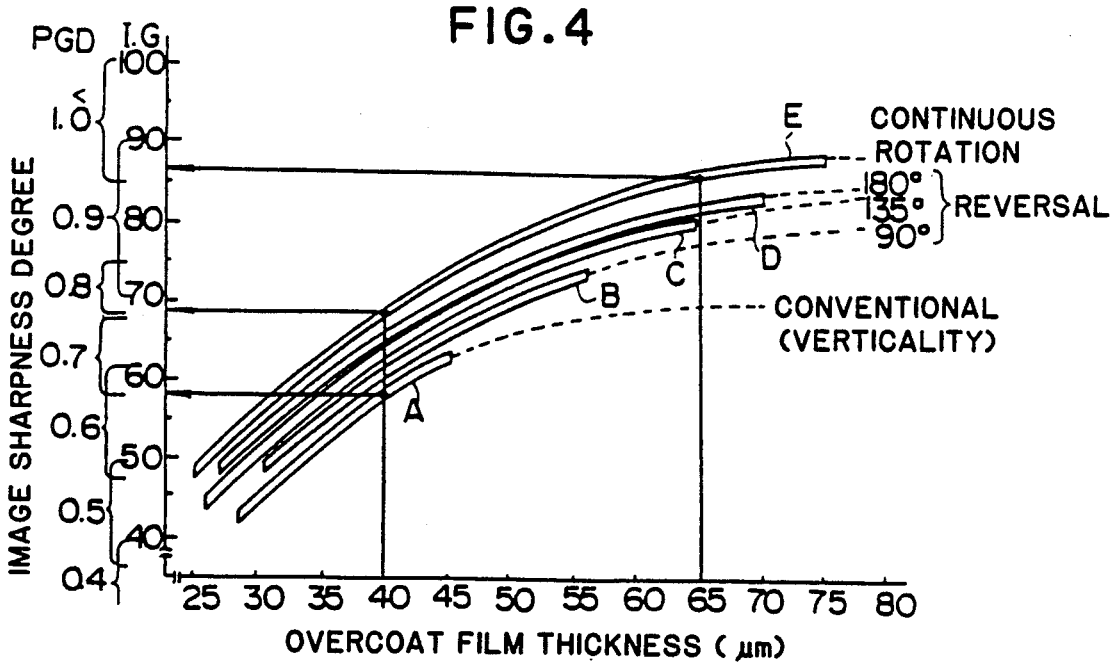
FIG. 4 is a graph showing the relationship of the image sharpness degrees with the overcoat film thicknesses.

FIG. 4 shows the effects of the horizontal rotation of the vehicle body W on the degree of evenness. In FIG. 4, reference symbol A denotes a state of a coat coated where the vehicle body W is not rotated (by a conventional method). Reference symbol B in FIG. 4 denotes the state of a coat obtained by rotating the vehicle body W in a clockwise direction at the angle of 90° and then reversing direction and rotating the vehicle body back 90°, namely, rotating it from the position of FIG. 2(*a*) through (*b*) to (*c*) and then reversing it from the position (*c*) through (*b*) back to (*a*). Reference symbol C in FIG. 4 denotes the state of the coat obtained by rotating the vehicle body W at the angle of 135°, then reversing direction, and ending the rotation of the body at the original position, namely, rotating it from the position of FIG. 2(*a*) through (*b*) and (*c*) to (*d*) and then returning it from the position of FIG. 2(*d*) through (*c*) and (*b*) back to the original position (*a*). Reference symbol D in FIG. 4 denotes the state of the coat obtained by rotating the vehicle body W at the angle of 180°, namely, rotating the body from the position of FIG. 2(*a*) through (*b*), (*c*) and (*d*) to (*e*) and then back to the original position of FIG. 2(*a*) through (*d*), (*cl ) and (b*) from (*e*). Reference symbol E in FIG. 4 denotes the state of a coat obtained when the vehicle body W is rotated a full revolution in one direction, namely, from the original position of FIG. 2(*a*) through (*b*), (*c*), (*d*), (*e*), (*f*), (*g*) and (*h*) back again to the original position of FIG. 2(*i*), or FIG. 2(*a*).

As is apparent from the results of FIG. 4, if the film thicknesses of two coats are identical to each other, a higher degree of evenness in the coat is achieved when the vehicle body W is rotated (as shown by reference symbols B, C, D and E in FIG. 4) than when it is not rotated (as shown by reference symbol A in FIG. 4). It is also understood that, in instances where the vehicle body W is rotated, the round rotation of the vehicle body W in one direction by 360° is preferred to provide a coat with a higher degree of evenness. It should further be noted that, in instances where the vehicle body W is not rotated as in the conventional manner, the film thickness of the coat is restricted to a certain value, thus leading to limited degree of evenness.

By comparison, a film thickness of 65 μm formed by rotating the vehicle body W at 360°, provides a coat surface which gets an 87 on the I.G. (image gross) scale (the lower limit at a PGD value being 1.0). A film thickness of 40 μm scores a 58 on the I.G. scale (the lower limit at a PGD value being 0.7) when obtained without rotation of the vehicle body W and a 68 on the I.G. scale (the lower limit at a PGD value being 0.8) when obtained by rotating it at 360°.

As is known to the skilled in the art, it is noted that an I.G. (image gross) score is a ratio to an image sharpness degree relative to a mirror surface on a black glass being 100, and PGD values stand for a degree of identification of a reflected image and is rated so as to be decreased from 1.0 as the degree of evenness gets lower.

The data shown in FIGS. 3 and 4 were obtained under the following test condition under which the overcoating was carried out at the step P1:

a) Paint: melamine alkyd (black) Viscosity: 22 seconds/20° C. (measured by Ford Cup #4)
b) Film coater: Minibell (16,000 r.p.m.) Shaping air: 2.0 kg./cm$^2$
c) Spraying amounts (two times): First time: 100 cc/minute Second time: 150–200 cc/minute
d) Setting time/temperature: 10 minutes/room temperature
e) Baking temperature/time: 140° C./25 minutes
f) Degree of undercoat evenness: 0.6 (PGD value) (intermediate coat over PE tape)
g) Time period for rotation and reversal: 10 minutes (for the setting step) 10 minutes (for the baking step)
h) Material to be coated: The side surfaces of a square pipe with a 30 cm side are coated and supported so the pipe may rotate.
i) Rotational speed of the material to be coated: 6, 30 and 60 r.p.m. No difference has in fact been recognized.

Coating Line

Figure 5A:
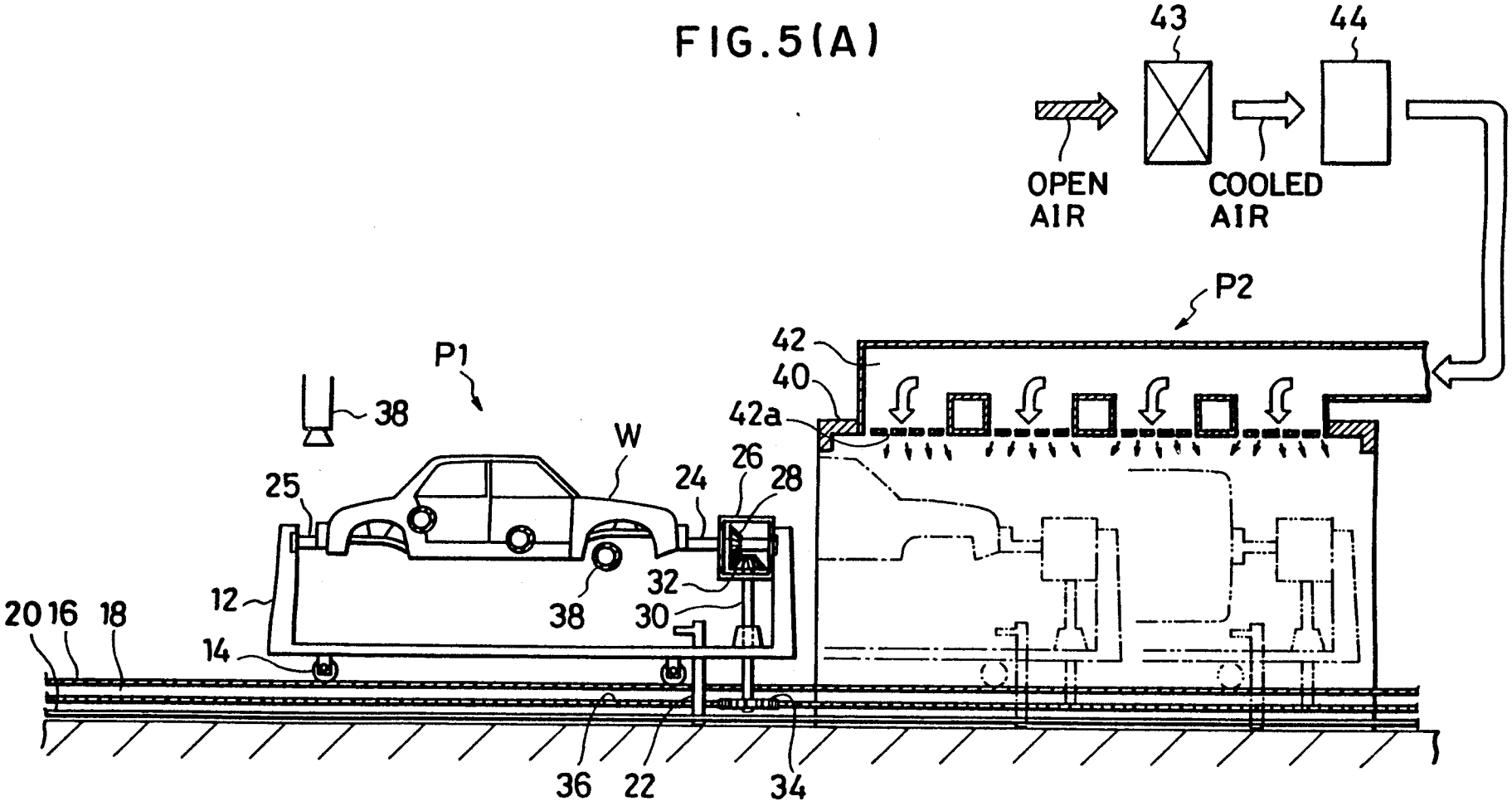
FIG. 5(*a*) is a partially sectional view showing the coating step and the cooling step of the coating line.
Figure 5B:
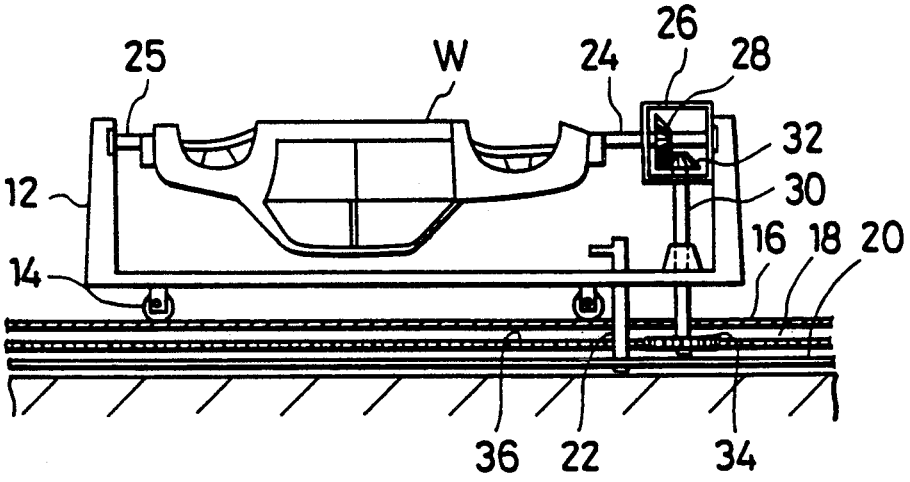
Figure 5C:
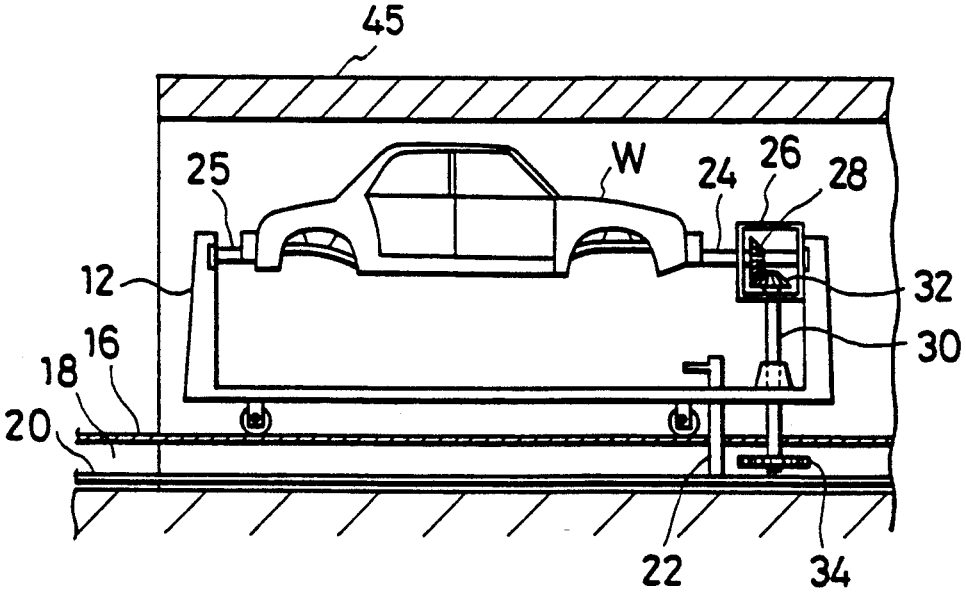

FIG. 5(*a*) shows the coating step P1 for spraying the vehicle body W with the paint and the cooling step P2 for cooling the coat formed on the vehicle body, which is disposed immediately after the coating step P1.

As shown in FIG. 5(*a*), reference numeral 12 denotes a carriage for conveying the vehicle body W along a coating line and the carriage 12 is disposed so as for its wheels 14 mounted on its bottom portion to run on a rail 16. In a pit 18 disposed under the ground on which the rail 16 is laid, a conveying chain 20 is disposed so as to be drivable by an appropriate drive means, and the carriage 12 is conveyed upon engagement with a rod 22 secured to the conveying chain 20.

The carriage 12 has a pair of body supporting shafts 24 and 25, located in its forward and rearward positions, respectively, for rotatably supporting the vehicle body W and extending in its horizontal and longitudinal direction. The body supporting shaft 24 is provided at its front end portion with a gear box 26 in which a bevel gear 28 is disposed. The bevel gear 28 is in mesh with another bevel gear 32 fixed at an upper end portion of a vertical rotary shaft 30 which in turn is rotatably held in a position forward of the vehicle body W. To a lower end portion of the vertical rotary shaft 30 is fixed a sprocket wheel 34 which in turn is engaged with a rotating chain 36 disposed inside the pit 18. The vertical rotary shaft 30 is rotated in association with rotation of the rotating chain 36, thereby rotating the body supporting shaft 24 through the bevel gears 28 and 32 and eventually leading to the rotation of the body W.

It is also noted that the vehicle body W may be rotated in the manner as disclosed in U.S. Pat. Nos. 4,874,639 and 4,919,977, and these prior patents are understood to be incorporated by reference in this application.

In accordance with the present invention, the vehicle body W is first undercoated with a paint in a manner known per se by those skilled in the art, such as by electrodeposition, followed by removing dirt from the vehicle body W by cleaning means such as air blowing. Thereafter, the vehicle body W is conveyed by the carriage 12 to the coating step P1 and the vehicle body W undercoated is sprayed with the paint through a coating line where the coating step P1 is carried out. In the coating line for the coating step P1, a plurality of coaters 38, 38 are disposed in appropriate positions upward of the body W and on the left and right sides thereof. During the conveyance of the vehicle body W in the coating step P1, a coat is formed by spraying the body W with the paint from the coaters 38, 38 continuously in order from its front portion through its middle portion to its rear portion. The spraying of the body W may be executed for 2 to 3 minutes.

For the coating method according to the present invention, a station for carrying out the cooling step P2 is provided in the coating line, adjacent the coating step P1, namely, in a position adjacent an exit section of the coating step P1 from which the vehicle body is removed after coating. The station for the cooling step P2 is provided with a cooling housing 40 having openings at its front and rear portions. The cooling housing 40 is provided at its upper portion with a plurality of a duct 42 through which cooled air is supplied to the housing 40. The duct 42 has a plurality of outlets 42*a* having openings directed downwardly to the inside of the housing 40 where the coat formed on the vehicle body W is cooled. The air to be supplied through the duct 42 and the outlets 42*a* thereof is cooled by a heat exchanger 43 which in turn cools open air and the cooled air is blown by a blower 44 into the cooling housing 40 through the duct 42 and its outlets 42*a*. After the coating step P1, the vehicle body W coated with the paint enters into the cooling step P2 followed by cooling the coat formed on the vehicle body W with the cooled air blown through the outlets 42*a* from the duct 42 of the housing 40, thereby increasing the viscosity of the paint in the coat formed thereon and consequently preventing the paint from sagging or dripping during a period of time when the vehicle body W is conveyed to the drying step P3.

Figure 6:
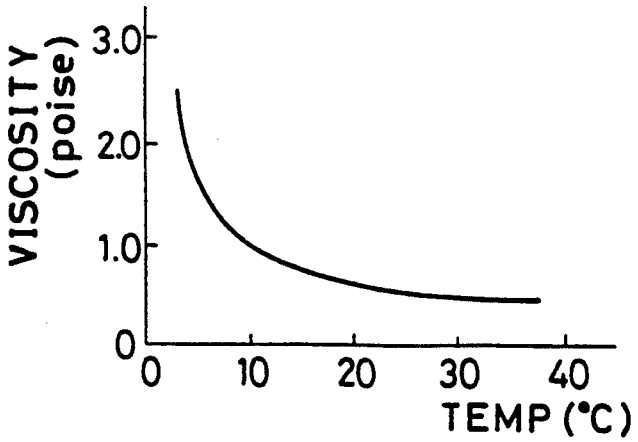
FIG. 6 is a graph showing the relationship of the viscosity of the paint with the temperature of the paint.

FIG. 6 shows the relationship of the viscosity of the paint, expressed in poise, with the temperature of the paint, expressed in centigrade. As shown in FIG. 6, it is shown that the paint having the viscosity of 0.6 poise at 20° C. is increased to about 2 poises when cooled to 5° C. It is thus to be noted that, although the temperature at which the coat formed on the vehicle body W is cooled is not restricted to a particular range of temperatures, the temperature may range from about 15° C. to about 3° C. although the temperature around 5° C. is preferred. The paint coated on the substrate can be cooled from temperature ranging from 5° C. to 10° C.

In a preferred aspect of the embodiment of the coating method according to the present invention, the vehicle body W is rotated in its substantially horizontal and longitudinal axis by the body supporting shafts 24 and 25 at such an stage at which the body W has been withdrawn from the coating step P1 and it has been conveyed nearly as a whole to the cooling step P2. The rotation of the vehicle body W is carried out in order to cool the coat formed thereon in a uniform fashion and to prevent the coat from sagging or dripping on a surface of the coat extending substantially upwardly and downwardly, or substantially vertically, particularly when the paint has been sprayed on the vehicle body W in a film thickness thicker than a thickness that the paint starts sagging. In the cooling step P2, the coat formed on the vehicle body W is cooled uniformly followed by uniformly increasing the viscosity of the paint of the coat formed thereon.

As have been described hereinabove, the vehicle body W is transferred to the cooling step P2 immediately after the completion of coating the body W with the paint in the coating step P1 and then cooled in the cooling step P2, thereby increasing the viscosity of the paint in the coat to such an extent to Which the paint does not sag or drip.

FIG. 5(*b*) shows the posture of the vehicle body W taken in the setting step of the rotary baking step P3 in which the body W is turned at the angle of 180° from the original position as shown in FIG. 5(*a*). In the setting step, solvents contained in the paint coated on the vehicle body W are caused to volatilize while being rotated in its substantially horizontal axis extending in the longitudinal direction of the body W. The vehicle body W is set to pass through the setting step over the period of approximately 7 minutes, although the time period during the body W is conveyed in the setting step may be shortened or extended in accordance with the kind of the paint and so on. The solvents in the paint of the coat sprayed on the vehicle body W may be volatilized in the setting step at ambient temperature or at elevated temperature, depending upon the kind of the paint used. In the setting step, the paint of the coat formed on the vehicle body W may be cured to such an extent that it does not sag or drip any longer on the surface of the coat extending vertically ever if it would have been stayed unrotated.

FIG. 5(*c*) showing the state of the vehicle body W in which the body W is placed in the baking step P3 to be executed after the setting step. The station for carrying out the baking step P3 has a drying oven 45 in a tunnel shape, which is provided with an appropriate heating means. In the baking step P3, the vehicle body W is baked at the temperature of 145° C., for example, after it has been conveyed to the baking step P3 from the setting step. As described hereinabove, the paint of the coat has been already cured and does not sag or flow any more so that it is not necessarily required to rotate the vehicle body W in the baking step P Yet it is preferred to rotate the body W about its substantially horizontal axis extending in the longitudinal direction thereof in order to bake the coat in a uniform fashion.

Figure 7:
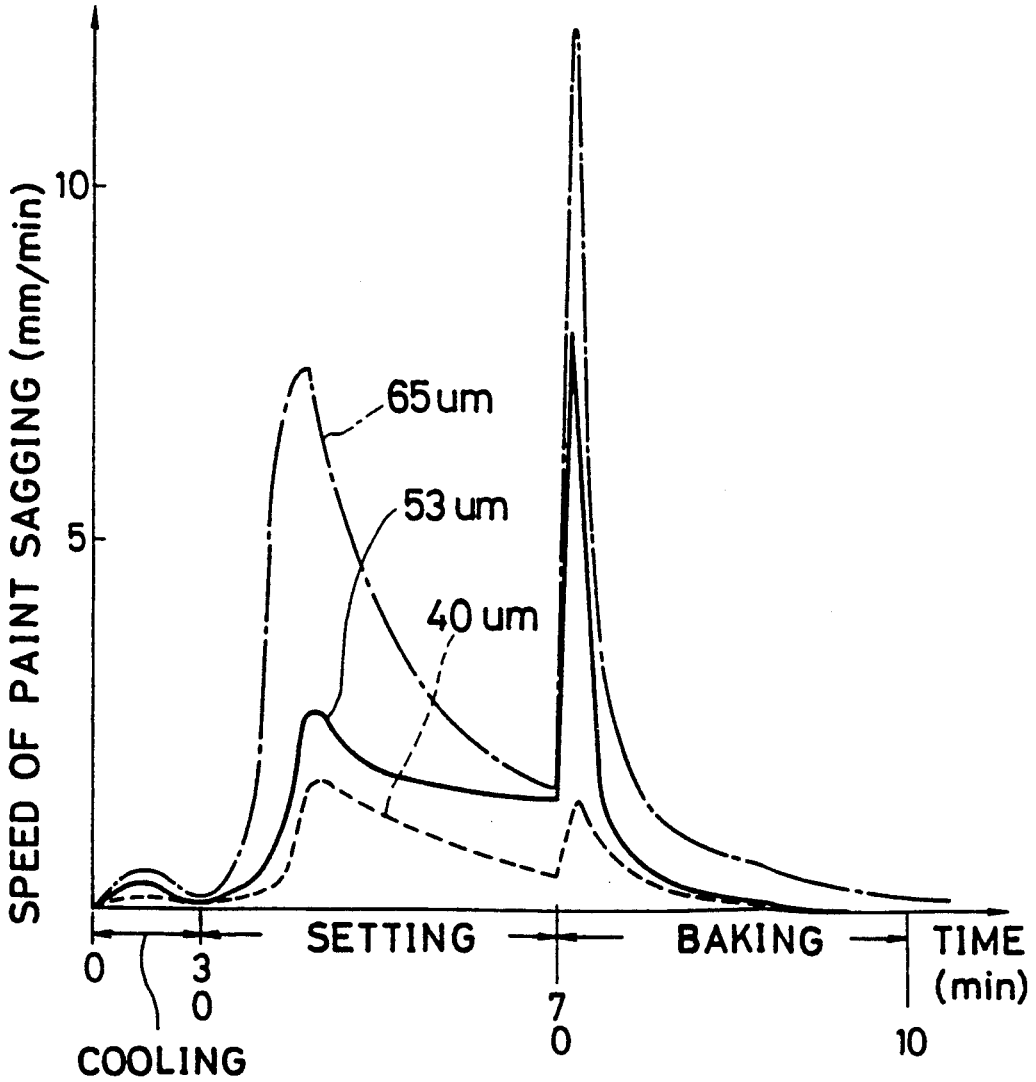
FIG. 7 is a characteristic graph showing the relationship of the speed of paint sagging of malamine alkyd, high-solid, thermoset-type paint having the initial viscosity of 0.6 poise with the time period for the cooling, setting and baking steps.

FIG. 7 corresponds to FIG. 3 and shows the relationship of the speed of paint sagging (mm per minute) vs. the time period (minutes) during which the coat is overcoated at the coating step P1, cooled at the cooling step P2, set and then baked at the baking step P3, when a melamine alkyd, high-solid, thermoset-type paint having the viscosity of 0.6 poise is sprayed so as to form overcoats having film thicknesses of 65, 53 and 40 microns.

As is apparent from the results shown in FIGS. 3 and 7, it is found that the speed of paint sagging does not increase even in four or five minutes after the paint has been sprayed, because the coat formed on the body W had been cooled in the cooling step so as to increase its viscosity immediately after the coating step, as shown in FIG. 7, while the coat formed thereon increases its viscosity in two or three minutes after coating, when the coat has not been cooled after the coating step, as shown in FIG. 3. Hence, it is found that the provision of the cooling step P2 in the coating method can delay the timing at which the paint flows downwardly or sags, thereby giving the sufficient time for the vehicle body W with the coat thereon to be conveyed from the coating step P1 to the drying step P3 without causing the paint of the coat to sag or drip.

As described hereinabove, the coat is rated as poor when a mark or marks would be left after drying to such an extent to which they can visually be observed, which is or are given by moving or flowing by 1 to 2 mm from the site on which the paint has been sprayed, and the sagging limit of the paint is a maximum value at which such a mark or marks is or are not left. Turning now to FIG. 7, it is found that the coat having the film thickness of 40 microns exceeds its sagging limit in about 7 minutes, the coat having the film thickness of 53 microns exceeds its sagging limit in about 5 or 6 minutes, and the coat having the film thickness of 65 microns exceeds its sagging limit in about 4 or 5 minutes. Therefore, the sagging of the paint from the coat formed on the vehicle body W can be prevented when the coat formed on the body W starts setting while being rotated in the manner as described hereinabove, prior to the time when the film thickness of the coat to be formed thereon reaches the sagging limit of the paint.

Figure 8:
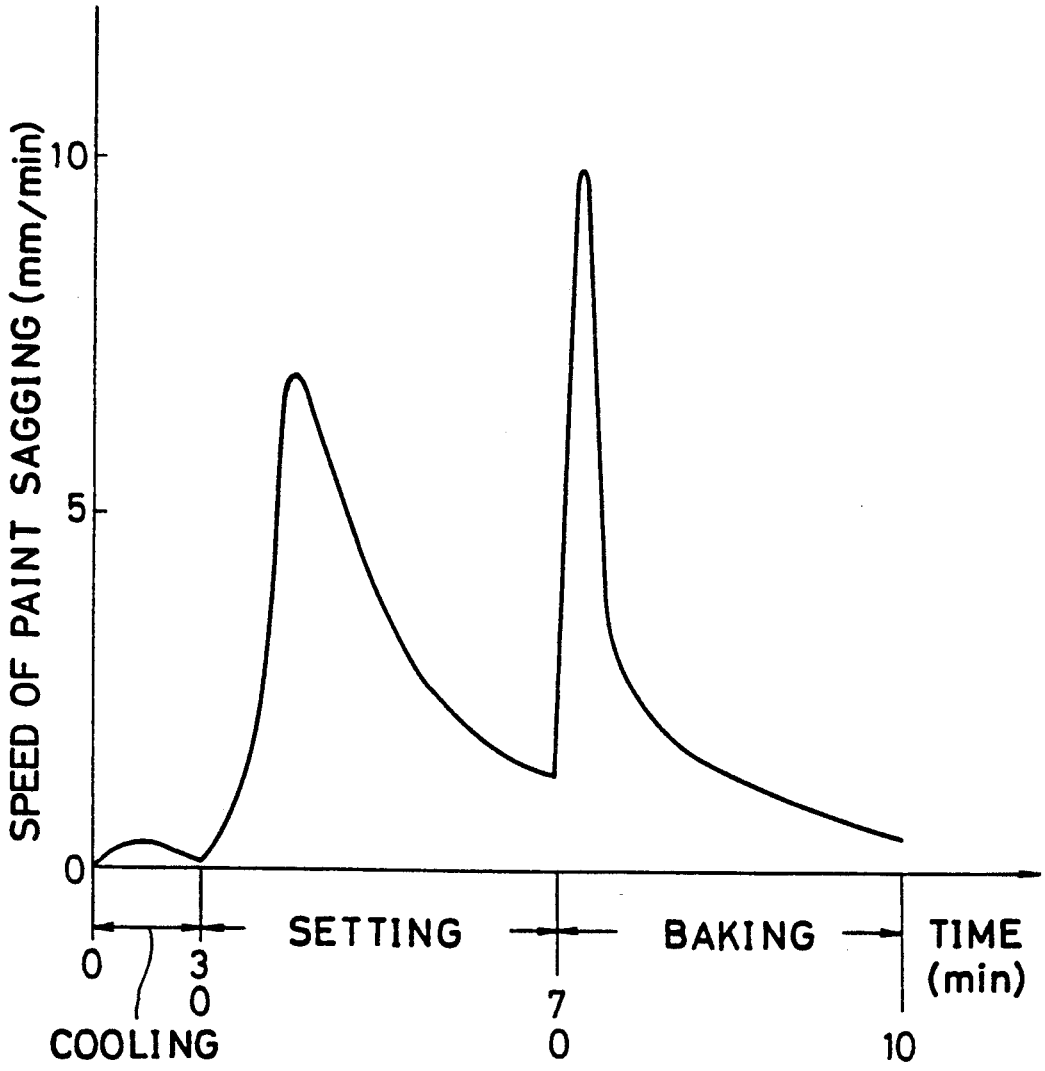
FIG. 8 is a characteristic graph showing the relationship of the speed of paint sagging of malamine alkyd, high-solid, thermoset-type paint having the initial viscosity of 0.2 poise with the time period for the cooling, setting and baking steps.

FIG. 8 shows the instance where the melamine alkyd high-solid, thermoset-type paint having the viscosity of 0.2 poise is sprayed on the vehicle body W.

Figure 9:
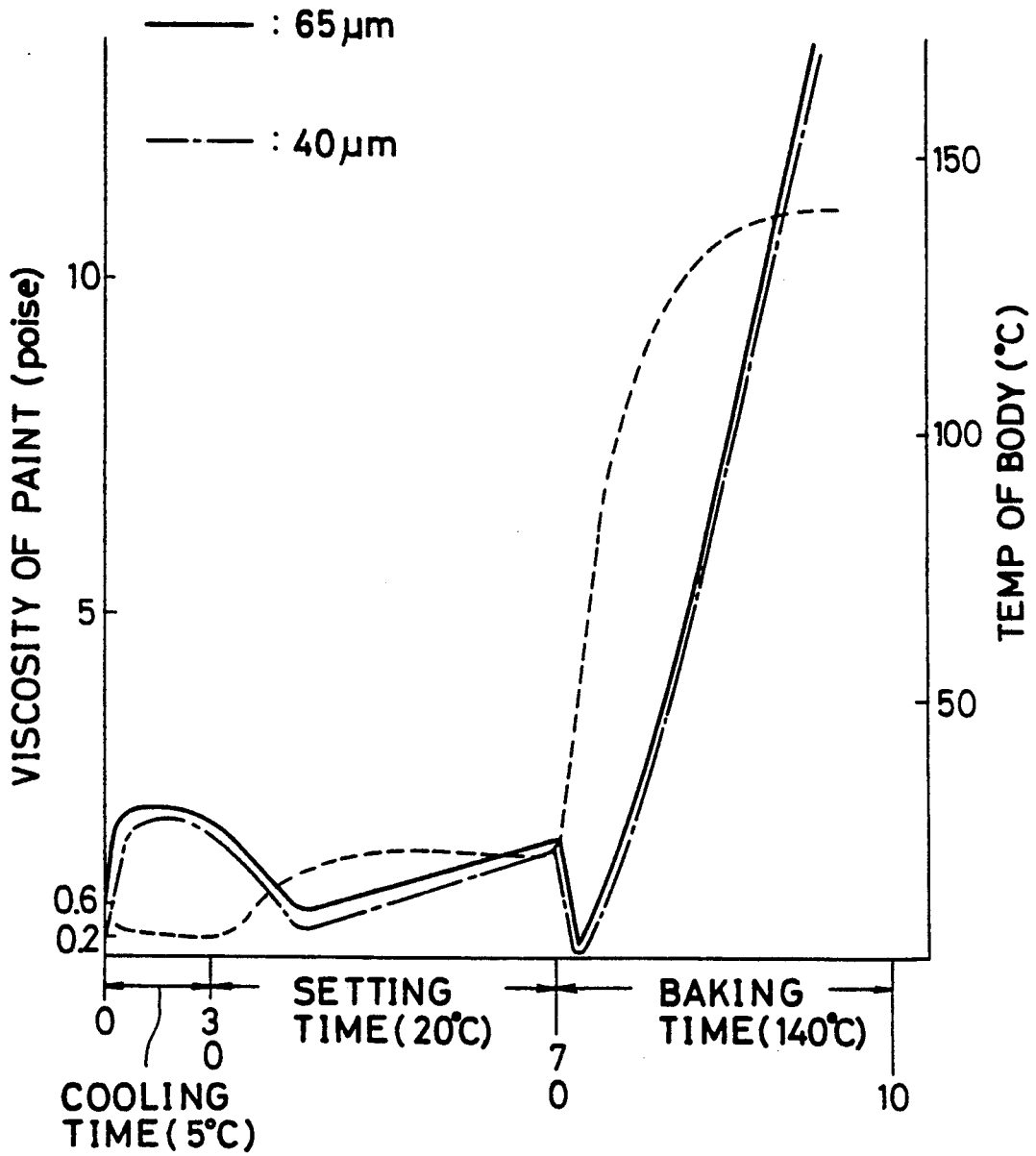
FIG. 9 is a characteristic graph showing the relationship of the speed of paint sagging of malamine alkyd, high-solid, thermoset-type paints having the initial viscosities of 0.6 and 0.2 poises with the time period for the cooling, setting and baking steps.

FIG. 9 shows the results when the melamine alkyd, hid-solid, thermoset-type paint having the initial viscosity of 0.6 poise is sprayed to form a coat having the film thickness of 65 microns, as represented by the solid line, and when the paint having the initial viscosity of 0.2 poise is sprayed to form one having the film thickness of 40 microns, as represented by the dot-dash line. In the drawing, the broken line means the temperature of the body W.

Figure 10:
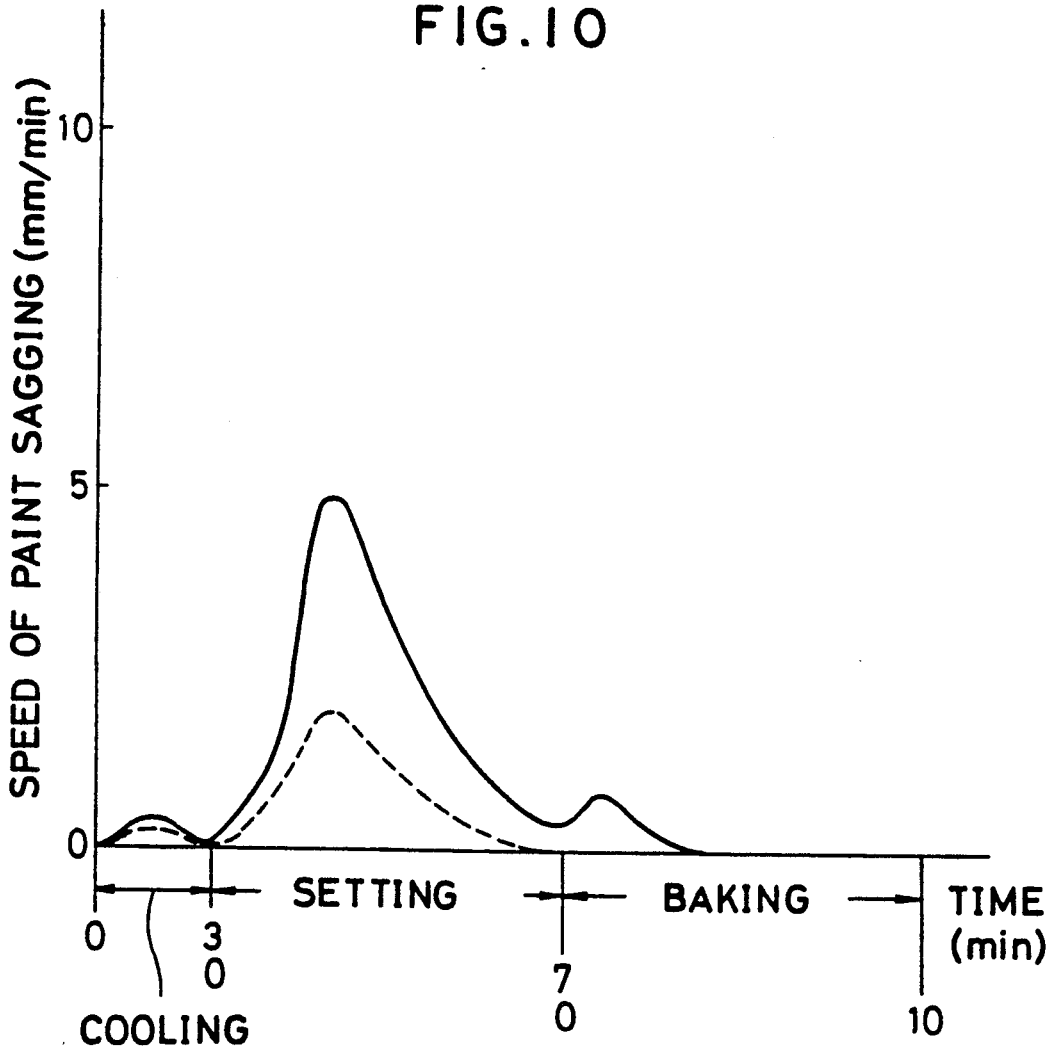
FIG. 10 is a characteristic graph showing the relationship of the speed of paint sagging of a two-liquid, reactive-type paint having the initial viscosity of 0.6 poise with the time period for the cooling, setting and baking steps.
Figure 11:
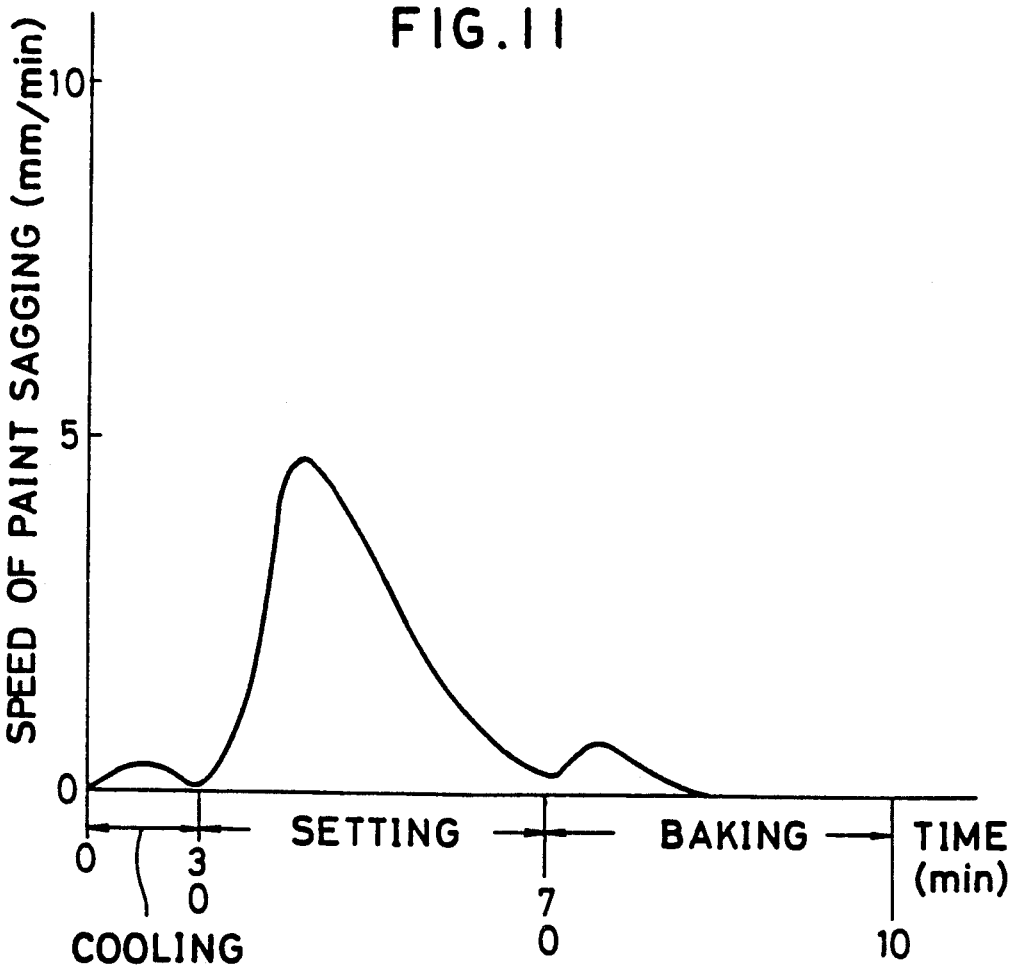
FIG. 11 is a characteristic graph showing the relationship of the speed of paint sagging of a two-liquid, reactive-type paint having the initial viscosity of 0.2 poise with the time period for the cooling, setting and baking steps.

The two-liquid paints gave the results similar to those obtained in FIG. 9. As shown in FIG. 10, the solid line represents the instance where the two-liquid paint having the initial viscosity of 0.6 poise has been sprayed so as to form a coat having the film thickness of 65 microns while the broken line represents the instance of the paint having the initial viscosity of 0.6 poise being sprayed so as to form a coat having the film thickness of 40 microns. On the other hand, FIG. 11 shows the case where the paint having the initial viscosity of 0.2 poise is sprayed on the vehicle body W. From the results as shown in FIGS. 10 and 11, the provision of the cooling step P2 behind the coating step P1 can present the advantage that the timing of sagging the paint coated on the vehicle body W can be delayed, thereby providing the sufficient time for transferring to the setting step from the coating step without causing the paint to sag or drip during the time period when the coated body is conveyed.

Table 2 shows the test results, as expressed by the IG values (image sharpness gross values) and the PGD values of coats having film thicknesses of 50–55 microns and 62–68 microns, which are obtained by separately spraying a bonnet and a door with the paint and cooling immediately after the coating step and, by comparison, which are obtained without cooling immediately thereafter. From the results as shown in Table 2, it has been found that there is little difference in the IG and PGD values between the two categories of the coats. This means that the cooling of the overcoat immediately after coating does not adversely affect the coat finish at all. Table 3 shows the finish results obtained by spraying the bonnet and the door separately with different paints having different viscosities.

TABLE 2

| Film Thickness, micron | Without Cooling Step | | | | With Cooling Step | | | |
|---|---|---|---|---|---|---|---|---|
| | Bonnet | | Door | | Bonnet | | Door | |
| | IG | RGD | IG | RGD | IG | RGD | IG | RGD |
| 50–55 | 87 | 0.9 | 83 | 0.8 | 87 | 0.9 | 84 | 0.8 |
| 62–68 | 98 | 1.2 | 93 | 1.0 | 97 | 1.2 | 93 | 1.0 |

TABLE 3

| Kind of Paints | Film Thickness micron | Viscosity poise | Bonnet | | Door | |
|---|---|---|---|---|---|---|
| | | | IG | RGD | IG | RGD |
| Melamine alkyd, overcoating | 65 | 0.6 | 97 | 1.2 | 93 | 1.0 |
| Acryl melamine, overcoating | | | 98 | 1.2 | 94 | 1.0 |
| Polyester melamine (intercoating) (thermoset, oil-free polyester) | | | 90 | 0.9 | 85 | 0.8 |
| Polyester, urethane (over- & intercoating) | | | 99 | 1.2 | 95 | 1.0 |
| Melamine alkyd | 40 | 0.2 | 97 | 1.2 | 93 | 1.0 |
| Acryl melamine | | | 97 | 1.2 | 93 | 1.0 |
| Polyester melamine (thermoset, oil-free polyester) | | | 89 | 0.9 | 85 | 0.8 |
| Polyester, urethane | | | 98 | 1.2 | 94 | 1.0 |

Referring back to FIG. 1, a step P2' for changing carriages may be disposed after the cooling step P2, as shown by dot line in the drawing, in which the vehicle body W is transferred to a carriage 12 which is designed for exclusive use with the drying step P3. The addition of the step P2' to the coating line of the coating method according to the present invention can present the advantage that the paint stuck to the carriage 12 used for the coating and cooling steps can be prevented from scattering and adhering to the vehicle body W in the drying step P3, particularly in the baking step, where the coat formed on the body W is baked at a considerably high temperature. The cooling of the coat enables the addition of the step P2' to the cooling step P2 because the paint in the coat is cooled and the sagging of the paint is delayed for a certain period of time after the coating step P1.

It is to be understood that the foregoing text and drawings relate to embodiments of the present invention given by way of examples but not limitation. Various other embodiments and variants are possible within the spirit and scope of the present invention.

What is claimed is:

1. A coating method comprising a coating step for spraying a substrate with a paint and a drying step for drying the paint sprayed on the substrate;

wherein the coating step is to spray a surface of the substrate extending substantially upwardly and downwardly with the paint to form a coat in a thickness thicker than a thickness ar which the paint starts sagging;

the drying step is to dry the coat formed on the substrate by rotating the substrate about its axis extending in a substantially horizontal and longitudinal direction of the substrate for a period of time ranging from the time when the paint coated starts sagging on the surface of the substrate extending substantially upwardly and downwardly to the time when the paint of the coated formed thereon achieves a substantially sagless state, the rotation of the substrate sprayed with the paint thereon being carried out at a speed which is high enough to rotate the substrate from a vertical position to a horizontal position before the paint coated thereon substantially sags due to gravity yet which is low enough so as to cause no sagging as a result of centrifugal force; and a cooling step for cooling with cool air the coat formed by spraying the substrate with the paint is provided immediately after the coating step yet before the drying step.

2. A coating method as claimed in claim 1, wherein the drying step comprises a setting step and a baking step to be carried out at a temperature which is higher than a temperature at which the setting step is carried out.

3. A coating method as claimed in claim 1, wherein the paint contains a volatilizable component.

4. A coating method as claimed in claim 1, wherein the paint is a two-liquid, reactive-type paint containing a main resin and a curing agent.

5. A coating method as claimed in claim 1, wherein the paint has a resin having a number-average molecular weight ranging from 2,000 to 20,000.

6. A coating method as claimed in claim 1, wherein the paint is sprayed at its initial viscosity of 0.6 poise.

7. A coating method as claimed in claim 1, wherein the paint is spraying at its initial viscosity of 0.2 poise.

8. A coating method as claimed in claim 1, wherein the drying step comprises a setting step and a baking step to be carried out at a temperature which is higher than a temperature at which the setting step is carried out;

the paint is of a type which causes sagging at both the setting step and the baking step; and the rotation of the substrate about its substantially horizontal axis extending in its longitudinal direction is carried out at both the setting step and the baking step.

9. A coating method as claimed in claim 1, wherein the drying step comprises a setting step and a baking step to be carried out at a temperature which is higher than a temperature at which the setting step is carried out;

the paint is of a type which causes sagging at both the setting step and the baking step; and the rotation of the substrate about its substantially horizontal axis extending in its longitudinal direction is carried out at least at the setting step.

10. A coating method as claimed in claim 1, wherein the substrate is a vehicle body; and the vehicle body is sprayed with the paint in the coating step and cooled in the cooling step, while the vehicle body is being conveyed.

11. A coating method as claimed in claim 1, wherein the substrate is a vehicle body; and the vehicle body is treated at each of steps while the vehicle body is being conveyed in a series of the steps ranging from the coating steps to drying step.

12. A coating method as claimed in claim 1, wherein the paint coated on the substrate is cooled at temperatures ranging from 5° C. to 10° C.

13. A coating method as claimed in claim 10, wherein the paint coated on the substrate is cooled at temperatures ranging from 5° C. to 10° C.

14. A coating method as claimed in claim 1, wherein the paint coated on the substrate is cooled by blowing cool air upon the substrate.

15. A coating method as claimed in claim 1, wherein the substrate is treated at each of the steps while the vehicle body is held on a carriage during a period of time ranging from the coating step to the drying step.

16. A coating method as claimed in claim 15, further comprising a step for changing carriages, which is disposed between the cooling step and the drying step.

17. A coating method as claimed in claim 1, wherein the axis about which the substrate is rotated passes through the center of gravity.

18. A coating method as claimed in claim 1, wherein the substrate is sprayed two times with the paint so as to form a coat having a given film thickness.

19. A coating method as claimed in claim 1, wherein the substrate is rotated in one direction.

20. A coating method as claimed in claim 19, wherein the substrate is rotated continuously.

21. A coating method as claimed in claim 19, wherein the substrate is rotated intermittently.

22. A coating method as claimed in claim 1, wherein the substrate is rotated in one direction and then reversed in the opposite direction.

23. A coating method as claimed in claim 1, wherein the substrate is rotated at a speed of 380 cm per second or lower, as measured at a radially outward tip portion of the substrate.

* * * * *